US005199568A

United States Patent [19]

Streit et al.

[11] Patent Number: 5,199,568

[45] Date of Patent: Apr. 6, 1993

[54] CARD DISPLAY AND STORAGE CONTAINER

[76] Inventors: Kenneth F. Streit, 414 S. Seegwun Ave., Mt. Prospect, Ill. 60056; Richard J. Petrus, 619 Sycamore La., Wheeling, Ill. 60090

[21] Appl. No.: 910,845

[22] Filed: Jul. 8, 1992

[51] Int. Cl.[5] ..... B65D 5/44

[52] U.S. Cl. ..... 206/443; 206/455; 220/529

[58] Field of Search ..... 206/455, 456, 45.11, 206/44 B; 40/124.2, 152.1, 155, 156

[56] References Cited

U.S. PATENT DOCUMENTS

| | | | |
|---|---|---|---|
| Re. 30,624 | 5/1981 | Soulakis et al. | 206/45.13 |
| 1,871,569 | 8/1932 | Warshaw | 200/44 B |
| 3,554,429 | 1/1971 | Cohen | 229/15 |
| 4,305,498 | 12/1981 | Paytas | 206/455 |
| 4,643,306 | 2/1987 | Ryan | 206/44 B |
| 4,696,395 | 9/1987 | Rivoli | 206/334 |
| 4,957,213 | 9/1990 | White et al. | 220/559 |
| 4,958,728 | 9/1990 | Effendi | 206/44 B |
| 4,995,508 | 2/1991 | Burley | 206/44 B |

*Primary Examiner*—Joseph Man-Fu Moy

*Attorney, Agent, or Firm*—Willian Brinks Olds Hoffer Gilson & Lione

[57] ABSTRACT

A collector card storage and display container is provided which includes a base member having a floor, two end walls and two side walls and constructed using a clear plastic material; a hard-coated cardboard inner liner separated from the floor and end walls by a plurality of spacers; and a lid. The inner liner, floor, walls and spacers define a plurality of display compartments, each of which can hold one collector card which can be viewed from the outside through the clear plastic walls of the base member. The inner liner and floor also define a larger, inner storage compartment for storing a much larger number of collector cards not being displayed.

20 Claims, 4 Drawing Sheets

CARD DISPLAY AND STORAGE CONTAINER

FIELD OF THE INVENTION

The present invention is directed to a container for storing and displaying collector cards including baseball cards, football cards and the like.

BACKGROUND OF THE INVENTION

The increasing popularity of American sports and other special interests, and the considerable media attention directed to individual sports figures, have helped facilitate a strong interest in collector cards which depict individual sports figures in action. This increasing interest in collector cards has, in turn, caused many previously issued collector cards, of which only a limited number are available, to become more and more valuable. As the value of collector cards increases, those cards which are in "mint condition", i.e., which are well preserved, undamaged, unfolded and unscratched, tend to increase in value much faster than cards which have been damaged, scratched or bent. Accordingly, it has become increasingly important to devise storage containers which, to the extent possible, preserve the collector cards in their original condition. Also, it is highly desirable for a storage container to be attractive and impressive to users, viewers, buyers and sellers of the collector cards, without significantly adding to the cost of the cards.

Presently, many collector cards are packaged and sold in rectangular cardboard boxes which are capable of storing anywhere from about 25 to about 900 cards, depending on the size of the box. One such cardboard box is disclosed in U.S. Pat. No. 4,957,213, issued to White et al. The box disclosed therein is a single-piece, base and lid assembly with a rectangular storage base and a fold-over lid with flaps to secure the lid in the closed position. The box also includes a stopping device for maintaining the cards in an orderly fashion when the box is only partially full.

U.S. Pat. No. 3,554,429, issued to Cohen, discloses a paperboard or plastic container which utilizes one or more notched inserts to permit compartmentizing of the container. A plurality of partitions are inserted into the notches and are thereby maintained in a spaced relationship to create the individual compartments.

U.S. Pat. No. 4,696,395, issued to Rivoli, discloses a rectangular container in which a plurality of workpieces are stored in an upright position using a pair of upright members having V-shaped notches which face inward from the sides of the container. The upright members are mounted to a base plate which includes an adjustable slide mechanism for allowing one of the upright members to be moved closer to or further away from the other upright member, as needed, depending on th size of the workpieces being stored.

U.S. Pat. Re. No. 30,624, issued to Soulakis et al., discloses a storage container for index cards having a hollow base and a lid pivotally mounted on the base, with a carrier pivotally mounted on the lid. The carrier, which supports the index cards being stored, is completely inside the base when the lid is closed. When the lid is open, the carrier moves to a partially elevated position to facilitate easier insertion, removal and viewing of the cards.

SUMMARY OF THE INVENTION

The present invention is a new storage and display container for collector cards including baseball cards, football cards, and the like, which is inexpensive to produce while at the same time having an attractive and impressive appearance. The collector card container of the invention includes a hollow, rectangular base portion constructed from a transparent, rigid or semi-rigid plastic material; and inner liner preferably made from a polished or waxed, hard finished cardboard material similar to the material of the cards being stored; and a lid which slidably engages the rectangular base portion. The collector card container also preferably includes a stop device which can be used to maintain the cards in an upright, organized fashion when the collector card box is only partially full.

The rectangular base portion has a floor, two ends and two longitudinal side walls. Each of the longitudinal side walls and end walls includes one or more vertical, inward-facing protrusions which are laterally spaced from each other and/or from an end of the container at a distance approximately equal to or slightly larger than the width of the collector cards being stored. The floor preferably includes a slot which receives the lower end of the inner liner and helps maintain the inner liner in an upright position adjacent to the protrusions facing inward from the ends and sides. The inner liner, floor, end walls, side walls and protrusions define a plurality of display compartments located around the perimeter of the base. Each of the compartments is of a size and shape ideal for storing, maintaining in an upright position, and displaying through a "window" in the transparent base, one collector card.

The inner liner and floor also define a rectangular inner compartment in which most of the collector cards are stored in an upright position. The rectangular inner compartment has a width which is approximately equal to, or slightly greater than, the width of the collector cards being stored. Within the inner compartment, a stop may be employed to maintain the collector cards in an upright, organized fashion when the inner compartment is only partially full.

With the foregoing in mind, it is a feature and advantage of the invention to provide a collector card storage and display container having an attractive appearance which includes a plurality of windows located around the perimeter of the box, through which individual collector cards can be displayed and advertised.

It is also a feature and advantage of the invention to provide a collector card storage and display container in which a large number of collector cards can be stored, transported, removed and inserted, using ordinary care, without damaging, scratching or bending the cards.

It is also a feature and advantage of the invention to provide a collector card storage container which can be mass produced at a minimal cost and which can be purchased and used economically by packagers, sellers, buyers and collectors of cards.

The foregoing features and advantages of the invention will become further apparent from the following detailed description of the presently preferred embodiments, when read in conjunction with the accompanying figures. The detailed description and figures are to be construed as illustrative rather than limitative, with the scope of the invention being defined by the appended claims.

DETAILED DESCRIPTION OF THE PRESENTLY PREFERRED EMBODIMENTS

Figure 3:
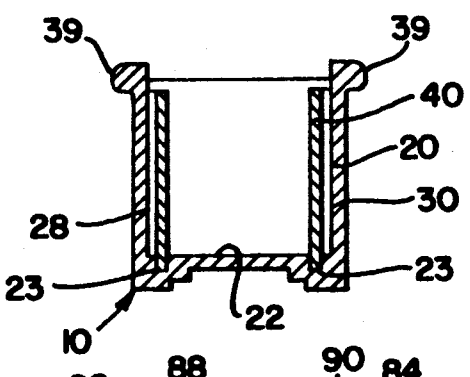
FIG. 3 is another sectional view, taken along the line 3—3 in FIG. 1.
Figure 1:
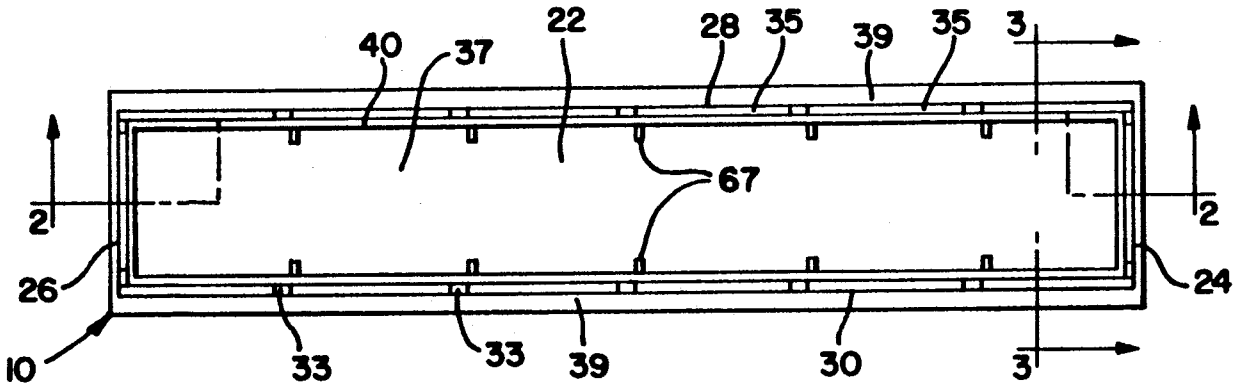
FIG. 1 is a top plan view of the collector card container of the invention, with the lid removed and without cards.
Figure 2:
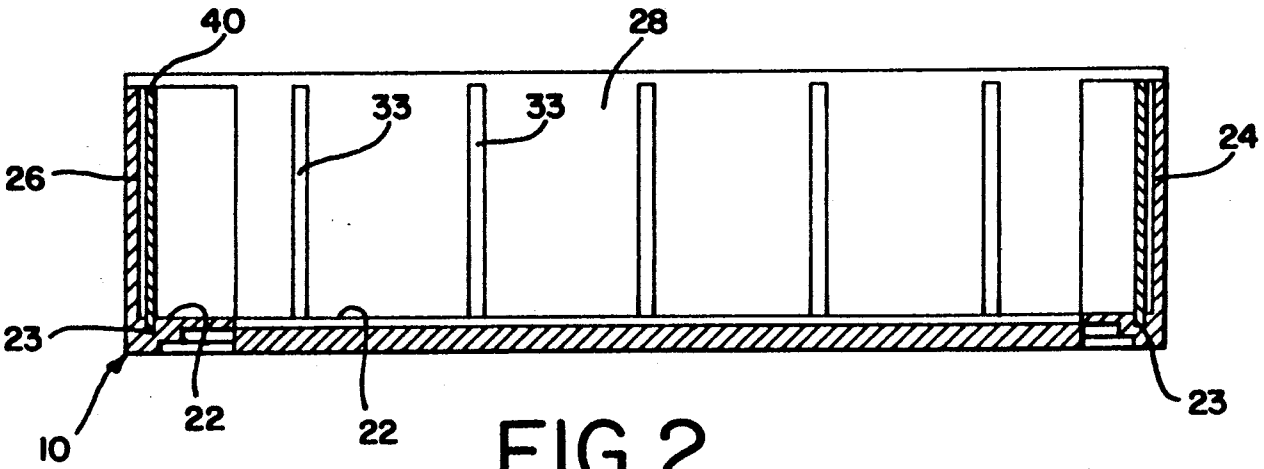
FIG. 2 is a side sectional view taken along the line 2—2 in FIG. 1.
Figure 4:
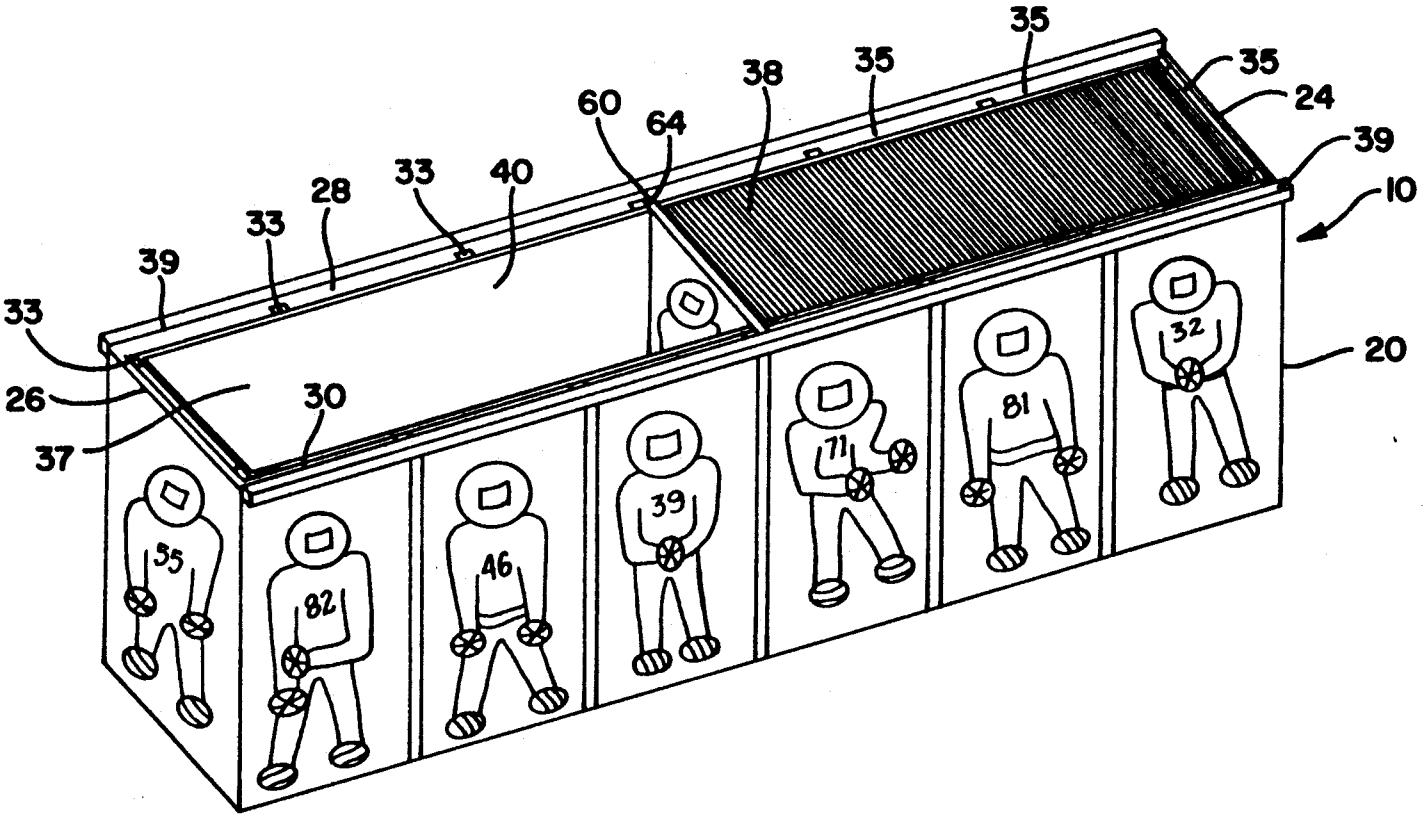
FIG. 4 is a perspective view of the collector card container of the invention, without the lid but partially filled with cards.

Referring first to FIG. 4, the collector card container 10 of the invention includes a base member 20, an inner liner member 40, a stop member 60, and a lid member 80 shown in FIGS. 9–12. The base member 20 includes a floor 22 as shown in FIGS. 1–3, end walls 24 and 26, and longitudinal side walls 28 and 30. The longitudinal side walls 28 and 30, and end walls 24 and 26, include a plurality of vertical, inward-facing protrusions 33 which, as shown in FIG. 2, have a rectilinear configuration.

The inward-facing protrusions 33 are preferably spaced from each other and/or from the end walls 24 and 26, at distances about equal to or slightly greater than the width of the collector cards being stored in the container 10. The inner liner 40 is disposed in an upright position, a short distance from the side and end walls of the base member 20, and touching the inward-facing protrusions 33 which serve as spacers to help maintain a uniform distance between the liner 40 and the walls 24, 26, 28 and 30. The liner 40 is folded or broken at the corners of the base member 20 such that a rectangular portion of the liner is about parallel to each of the four walls. The height of the liner 40 is similar to the height of the cards being stored.

A plurality of rectangular outer display compartments 35 are defined by the end walls 24 and 26, the longitudinal side walls 28 and 30, the floor 22, the inner liner 40 and the inward-facing protrusions 33, as illustrated in FIGS. 1 and 4. In the embodiment shown in FIGS. 1 and 4, there are a total of fourteen outer compartments. Six of the outer compartments 35 are adjacent to each longitudinal side wall and one outer compartment 35 is adjacent to each end wall. Each of the outer display compartments has a width about equal to or slightly greater than the width of the cards being stored.

The base member 20 is constructed from a transparent, stiff (rigid or semi-rigid) polymer material and can be formed using injection molding or another suitable molding process. One highly suitable polymer material is a high impact modified polystyrene resin which is commercially known as K-resin, available from Phillips Chemical Company. K-resin is presently preferred due to its transparency, strength, rigidity and its relatively low cost. However, any suitable transparent plastic material can be used as long as the strength and stiffness of the material are sufficient to prevent significant bending or easy breakage of the container which might result in damage to the collector cards stored therein. The base member 20 can be somewhat tinted or colored, provided that the amount of tinting or color used is not so high as to significantly alter the transparency of the base member 20.

As shown in FIG. 4, a single collector card can be inserted, for display purposes, into each of the fourteen outer compartments 35. The inner liner 40 and the floor 22 also define a much larger, rectangular inner compartment 37, in which most of the collector cards 38 are stored in an upright position, perpendicular to the longitudinal side walls as shown. The inner liner 40 serves three functions including: 1) separating the collector cards in the outer display compartments 35 from each other and from the collector cards in the inner compartment 37, 2) helping maintain the cards 38 in the inner compartment 37 in an upright and organized position, and 3) protecting the cards 38 from damage, especially at the edges of the cards.

In order to accomplish these purposes, the inner liner 40 is preferably sized and scored so that it can engage all of the inward-facing protrusions 33 without experiencing excessive warping or bending (except at the four corners of the base 20). Also, in order to minimize edge damage to the cards 38, both the inner liner 40 and the base member 20 must be sized such that the cards 38 fit comfortably within the inner liner 40, in the standing position as shown, without being too snug or too loose with respect to the longitudinal surfaces of the inner liner 40. Preferably, the inner liner 40 is sized and scored such that the width of the inner compartment 37 is about equal to or slightly greater than the width of the collector cards 38 being stored therein.

The inner liner 40 is preferably formed of a polished or waxed, hard-finished cardboard which can be similar to the material of the collector cards being stored. However, other suitable materials can also be used for the inner liner 40 provided that there is sufficiently low friction between the liner and the edges of the cards, and sufficient flexibility in the liner, to facilitate easy removal, insertion and storage of the collector cards without causing edge damage.

Referring to FIGS. 2 and 3, the floor 22 of the base member 20 includes a continuous slot 23 which extends completely around the base 20 at a small but constant distance from the end walls 24 and 26 and longitudinal side walls 28 and 30. The slot 23 is positioned immediately below the inner liner 40 and runs adjacent to and below the rectilinear protrusions 33. The purpose of the slot 23 is to engage the lower end of the inner liner 40, in order to help maintain the liner 40 in an upright position and adjacent to the rectilinear protrusions 33. The floor 22 also includes a plurality of small slots 67 perpendicular to the inner liner 40 and in the vicinity of the protrusions 33, for positioning a stop device 60 as explained below. In order to minimize material costs, while maintaining the necessary strength of the container 10, the floor 22 is uniformly thicker along the sides and ends of the base member 20, than in the center, as shown.

Figure 6:
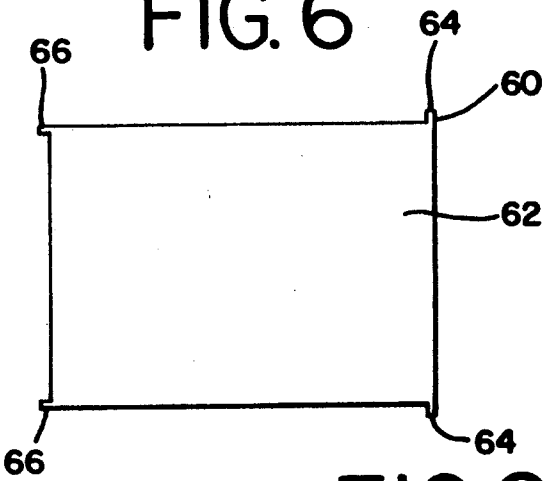
FIG. 6 illustrates the stop device of FIG. 5, rotated 90 degrees.
Figure 5:
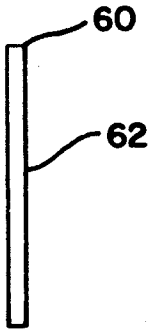
FIG. 5 is a top plan view of a stop device as used in FIG. 4 to maintain the collector cards in an upright, organized fashion.

As shown in FIG. 4, a stop device 60 is upright and organized fashion, when the container 10 is only partially filled with cards. Referring to FIGS. 5 and 6, the stop device 60 includes a wall portion 62 having two laterally extending tabs 64 at the top of the wall portion and two downward extending tabs 66 at the bottom of the wall protion. The wall portion 62 should preferably have a height slightly greater than the height of the inner liner 40 but similar to the height of the inward-facing protrusions 33, and a width slightly greater than the collector cards, in order to cause a snug fit between the stop device 60 and both longitudinal sides of the inner liner 40. However, the width of the wall portion 62 should not exceed the width of the inner compartment 37 except at the upper tabs 64. When the stop 60 is in place, the upper tabs 64 abut against the top portion of two of the inward facing protrusions 33 as shown in FIG. 4, while the lower tabs 66 fit within the floor slots 67 shown in FIG. 1. The stop device 60 can be molded from the same plastic material as the base member 20. The thickness of the stop device 60 should be sufficient to prevent the stop device from being easily bent or moved by the force exerted by the cards 38.

Figure 8:
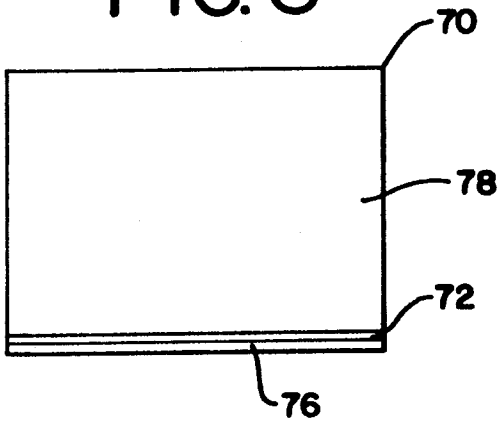
FIG. 8 illustrates the stop device of FIG. 7, rotated 90 degrees.
Figure 7:
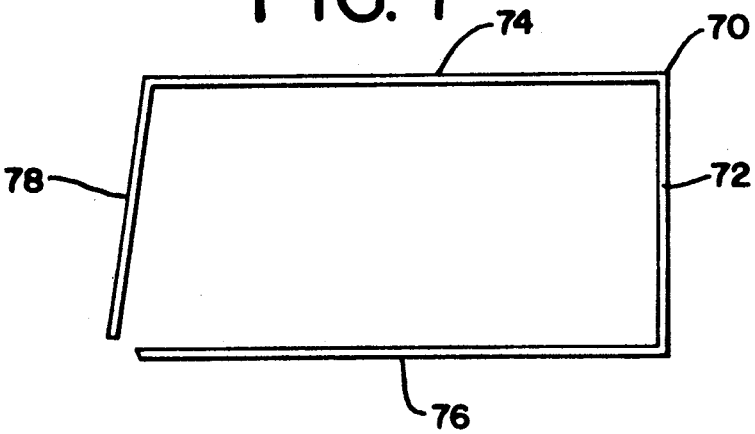
FIG. 7 is a top plan view of an alternative stop device, which can be used in place of the stop device of FIG. 5.

FIGS. 7 and 8 illustrate an alternative stop device 70 which can be used instead of the stop device 60. By making the stop device 70 somewhat larger than the stop device 60, as shown, it is possible to construct the stop device 70 from a lighter weight, less expensive material. The stop device 70 may be constructed of the same polished or waxed, hard coated cardboard material as the inner liner 40.

The stop device 70 includes a portion 72 having a height similar to, and a width slightly greater than the collector cards 38, and portions 74 and 76 which extend perpendicular to the portion 70 and which are somewhat longer in order to compensate for the lighter construction material. The stop device 70 also includes a foldable portion 78 which can be straightened or folded as desired depending on the position of the stop device 70, and the amount of empty space remaining, in the storage container 10.

Figure 12:
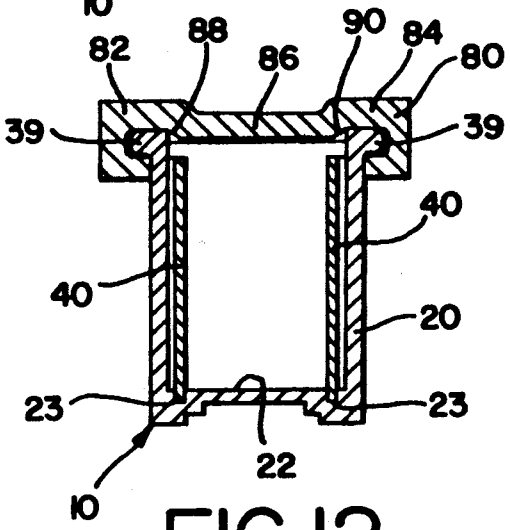
FIG. 12 shows the sectional view of FIG. 3 after the lid has been added.
Figure 9:
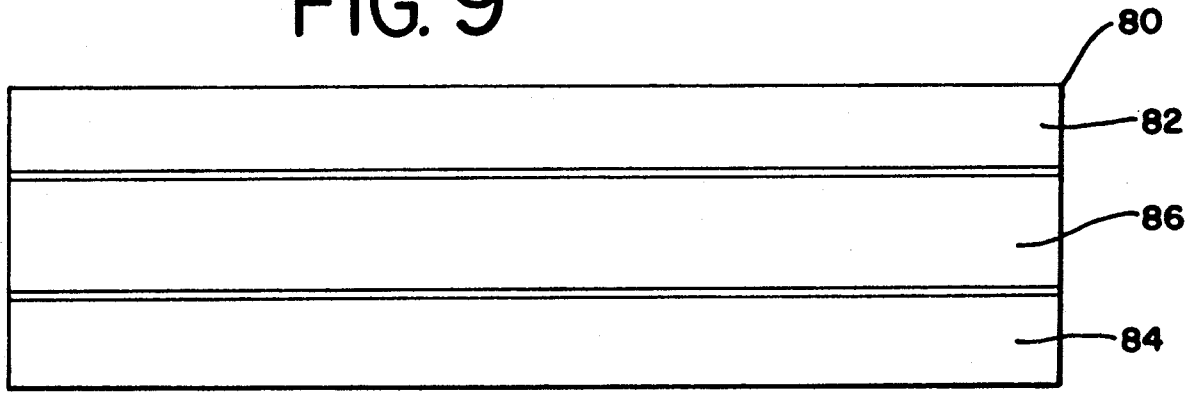
FIG. 9 is a top plan view of the lid.
Figure 10:
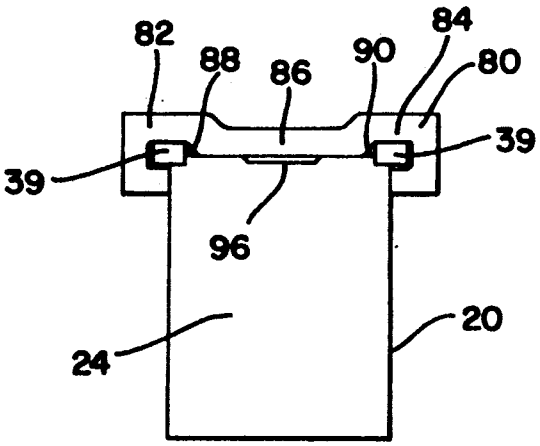
FIG. 10 is a first end view of the lid in combination with the base.

Referring to FIGS. 1 and 3, the base member 20 includes a pair of upper lips 39 which extend the length of the longitudinal side walls 28 and 30. The upper lips 39 are adapted to receive and slidably engage the container lid 80 illustrated in FIGS. 9–12. The lid member 80 includes raised portions 82 and 84 in the vicinity of its lateral edges, and a depressed portion 86 in the vicinity of its center, each of which extends the entire length of the lid as shown in FIG. 9. Slots 88 and 90, which also extend all or most of the length of the lid, are present on the underside of the lateral edges of lid 80 as shown in FIGS. 10–12.

When the lid member 80 is installed over the base member 20, the slots 88 and 90 in the lid member 80 interlock, partially surround and slidably engage the upper lips 39 on the base member 20, as shown in FIGS. 9–12. When the lid 80 is in place, the lowermost part of the depressed portion 86 of the lid 80 interacts with and partially abuts the uppermost parts of the longitudinal side walls 28 and 30 of the base member 20, in order to prevent excessive bending of the side walls 28 and 30 when the storage container 10 is being handled. In other words, when the storage container 10 is being handled, there is a tendency for the user to carry the container from the top with thumb and fingers pressed against the longitudinal side walls 28 and 30. When this occurs, the abutment between the depressed portion 86 of the lid 80, and the uppermost portions of the side walls 28 and 30, prevents excessive bending of the side walls which could otherwise cause damage to the collector cards in the container 10.

Figure 11:
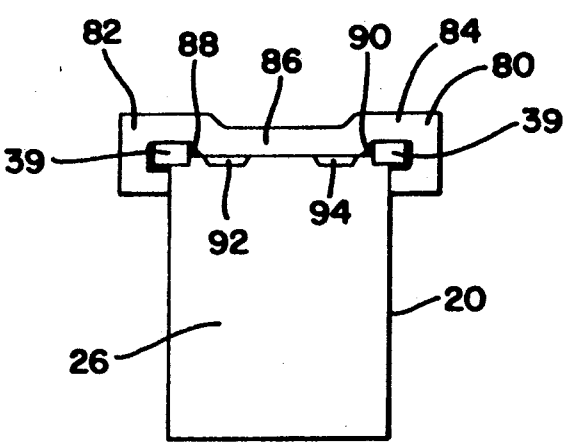
FIG. 11 is a second end view of the lid in combination with the base.

Referring to FIG. 11, two stop tabs 92 and 94 project downward from one end of the lid member 80. The stop tabs interact with the end 26 of the base member 20 when the lid 80 fully covers the base member 20, in order to prevent the lid 80 from sliding any further. Referring to FIG. 10, a detent 96 projects downward from the other end of the lid member 80. The detent 96 interacts with the end 24 of the base member 20 so as to snap the lid 80 into place when the lid 80 fully covers the base 20. The lid member 80 can be formed from a rigid or semi-rigid plastic material, such as polypropylene or another suitable material. The lid member 80 need not be transparent, and is preferably formed from a material that can be colored to assist in content identification and to help contribute an attractive, impressive overall appearance to the storage container 10.

The preferred dimensions of the collector card storage container of the invention will, of course, vary depending on the dimensions of the cards being stored and the number of cards being stored in a single container. Card boxes of the invention may be designed for storage of any commercially suitable number of cards. The embodiment described above, and illustrated in FIGS. 1–12, is intended for storing up to about 900 standard baseball or football cards, each of which has a height of about 3.5 inches and a width of about 2.5 inches. Referring to FIG. 4, the collector card container 10 has an overall length of about 16.0 inches, widths of about 3.1 inches for the base and about 3.4 inches for the lid (FIG. 9), and a height of about 3.57 inches without the lid or 3.64 inches with the lid.

The side walls 28 and 30, and the end walls 24 and 26, are each about 0.08 inches thick. The thickness of the floor 20 is generally about 0.065 inches but increases to about 0.155 inches at the edges. The inner liner 40 is about 0.015 inches thick. The distance between the inner liner 40 and the walls 24, 26, 28 and 30 is about 0.04 inches, which is also the distance that the protrusions 33 project inward from the walls. Each of the outer display compartments 35 has a width of about 2.55 inches, a height of about 3.57 inches and a depth of about 0.04 inches. The inner compartment 37 has a width of about 2.55 inches, a height of about 3.57 inches and a depth of about 15.5 inches.

Referring to FIGS. 4–6, the stop device 60 is generally about 3.55 inches high and has a width of about 2.56 inches for the wall portion 62. Each of the four tabs 64 and 66 has a width of about 0.045 inches. The stop device 60 has an overall thickness of about 0.07 inches. The stop device 60 stands slightly taller than the inner liner 40 in FIG. 4, due to the fact that the liner 40 is slightly embedded within the slot 23 on the floor 22. Referring to FIGS. 7 and 8, the alternative stop device 70 is about 3.5 inches high and about 0.04 inches thick, and has a width of about 2.56 inches for the portion 72. The portions 74 and 76 can have varying dimensions depending on the number of folds, etc.

While the embodiments of the invention disclosed herein are presently considered to be preferred, various changes and modifications can be made without departing from the spirit and scope of the invention. The scope of the invention is indicated in the appended claims, and all changes that fall within the meaning and range of equivalency of the claimed invention are intended to be embraced therein.

We claim:

1. A container for storing and displaying collector cards, comprising:

a base member comprising a floor, four walls, and a plurality of protrusions facing inward from the walls;

an inner liner disposed in an upright position at a substantially uniform distance from each of the four walls, the inner liner engaging the inward-facing protrusions in order to maintain the distance between the inner liner and the walls;

a plurality of outer display compartments for receiving and displaying individual collector cards, the display compartments being defined by at least one of the walls, the floor, the inner liner and the inward-facing protrusions, each display compartment having a width at least about equal to the width of the collector card being displayed; and an inner storage compartment defined by the inner liner and the floor for receiving and storing collector cards which are not being displayed, the inner storage compartment having a width at least about equal to the width of the collector cards being stored;

the base member further comprising a stiff, transparent construction material to facilitate viewing of the cards in the outer display compartments.

2. The container of claim 1, further comprising a slot in the floor for receiving and maintaining the inner liner in an upright position.

3. The container of claim 1, further comprising a stop device for maintaining the collector cards in an organized fashion when the container is only partially filled with cards.

4. The container of claim 1, further comprising upper lips on two of the walls for receiving and slidably engaging a lid.

5. The container of claim 4, further comprising a lid.

6. The container of claim 5, wherein the lid comprises a depressed center portion, two raised edge portions, and slots on the underside of the edge portions for slidably engaging the upper lips on the walls of the base member.

7. The container of claim 6, wherein the lid further comprises a stop tab projecting downward from an end of the lid for preventing further sliding of the lid over the base member when the lid fully covers the base member, and a detent projecting downward from an opposite end of the lid for snapping the lid into place when the lid fully covers the base member.

8. The container of claim 1, wherein the stiff, transparent construction material comprises a high impact modified polystyrene.

9. The container of claim 1, wherein the inner liner comprises a hard finished cardboard.

10. The container of claim 3, wherein the stop device comprises a high impact modified polystyrene.

11. The container of claim 3, wherein the stop device comprises a hard finished cardboard.

12. The container of claim 5, wherein the lid comprises a high impact modified polystyrene.

13. A container for storing and displaying collector cards, comprising:

a rectangular base member comprising a floor, four walls, and a plurality of rectilinear protrusions facing inward from the walls;

an inner liner disposed in an upright position at a distance from each of the four walls, such that portions of the inner liner are approximately parallel to each of the four walls, the inner liner engaging the rectangular protrusions in order to maintain the distance between the inner liner and the walls;

a plurality of outer display compartments for receiving and displaying individual collector cards, each of the display compartments being defined by at least one of the walls, at least one of the rectilinear protrusions, the floor and the inner liner, each display compartment having a width at least about equal to the width of the card being displayed; and a rectangular inner storage compartment defined by the inner liner and the floor for receiving and storing collector cards in an upright position, the inner storage compartment having a width at least about equal to the width of the collector cards being stored.

14. The container of claim 13, further comprising a lid.

15. The container of claim 13, wherein the rectangular base member further comprises a transparent polymer construction material.

16. The container of claim 13, wherein the rectangular base member comprises a high impact modified polystyrene.

17. The container of claim 13, wherein the inner liner comprises a hard finished cardboard.

18. A container for storing and displaying collector cards, comprising:

a rectangular base member comprising a stiff, transparent polymer construction material and further comprising a floor, two end walls and two longitudinal side walls;

a plurality of spacers disposed laterally at regular intervals along inner surfaces of the side and end walls, such that the distance between each of the spacers and the nearest lateral adjacent spacer is at least about equal to the width of the cards being stored;

an inner liner disposed in an upright position at a substantially uniform distance from each of the side and end walls, and engaging the spacers, the spacers being disposed between the inner liner and the walls;

a plurality of outer display compartments for receiving and displaying individual collector cards, each of the display compartments being defined by at least one of the walls, at least one of the spacers, the floor and the inner liner, each display compartment having a width at least about equal to the width of the card being displayed; and a rectangular inner storage compartment defined by the inner liner and the floor for receiving and storing collector cards in an upright position, the inner storage compartment having a width at least about equal to the width of the collector cards being stored.

19. The container of claim 18 comprising fourteen of the outer display compartments, wherein six of the display compartments are located adjacent to each longitudinal side wall and one of the display compartments is located adjacent to each end wall.

20. The container of claim 19 wherein five of the spacers are positioned along each side wall, and two of the spacers are positioned along each end wall, such that the lateral distance between each spacer and the nearest adjacent spacer is at least about equal to the width of the collector cards being displayed.

* * * * *

UNITED STATES PATENT AND TRADEMARK OFFICE

CERTIFICATE OF CORRECTION

PATENT NO. : 5,199,568

DATED : April 6, 1993

INVENTOR(S) : Kenneth F. Streit Et Al.

It is certified that error appears in the above-identified patent and that said Letters Patent is hereby corrected as shown below:

ON THE TITLE PAGE

In the second column, at "Attorney, Agent, or Firm", please delete "Hoffer" and substitute therefore --Hofer--.

In column 2, line 10, please delete "and" and substitute therefor --an--.

In column 5, line 5, after "60 is", please insert --preferably employed to maintian the collector cards in an--.

Signed and Sealed this

Twelfth Day of April, 1994

Bruce Lehman

BRUCE LEHMAN

*Commissioner of Patents and Trademarks*

*Attest:*

*Attesting Officer*